US005150019A

United States Patent [19]

Thomas et al.

[11] Patent Number: 5,150,019

[45] Date of Patent: Sep. 22, 1992

[54] INTEGRATED CIRCUIT ELECTRONIC GRID DEVICE AND METHOD

[75] Inventors: Michael E. Thomas, Milpitas; Kranti V. Anand, deceased, late of Sunnyvale, Calif., by Madhu Anand, heir

[73] Assignee: National Semiconductor Corp., Santa Clara, Calif.

[21] Appl. No.: 591,296

[22] Filed: Oct. 1, 1990

[51] Int. Cl.[5] ..... H01J 17/36; H01J 1/16

[52] U.S. Cl. ..... 315/350; 313/309; 313/336; 313/351

[58] Field of Search ..... 315/350; 313/307, 308, 313/309, 338, 351

[56] References Cited

U.S. PATENT DOCUMENTS

| | | | |
|---|---|---|---|
| 3,755,704 | 8/1973 | Spindt et al. | 313/309 |
| 3,789,471 | 2/1974 | Spindt . | |
| 3,855,499 | 12/1974 | Yamada | 313/336 X |
| 4,578,614 | 3/1986 | Gray et al. | 313/309 |
| 4,721,885 | 1/1988 | Brodie | 313/336 |
| 4,766,340 | 8/1988 | Van der Mast et al. | 313/309 X |
| 4,983,878 | 1/1991 | Lee et al. | 313/336 X |
| 5,003,216 | 3/1991 | Hicks | 313/309 X |
| 5,012,153 | 4/1991 | Atkinson et al. | 313/336 |

OTHER PUBLICATIONS

"Engineering Micro-Cavity Integrated Vacuum Tubes" by C. F. McConaghy, W. J. Orvis, D. R. Ciarlo and J. H. Yee of the Lawrence Livermore National Laboratory, in the International Vacuum Microelectronics Conference held at Williamsburg, Va. Jun. 12-15, 1988.

"Modeling and Fabricating Micro-Cavity Integrated Vacuum Tubes", by William J. Orvis, Charles E. McConaghty, Dino R. Ciarlo, Jick H. Yee and Ed W. Hee in IEEE Transactions on Electronic Devices, vol. 36, No. 11, Nov. 1989.

"A Progress Report on the Livermore Minature Vacuum Tube Project" by W. J. Orvis, D. R. Ciarlo, C. F. McConaghy, J. H. Yee, C. Hunt, J. Trujillo in the Nov. 1989 IEEE Publication IEDM CH2637-7/89/00-00-0529 from IEDM 89-529 to IEDM 89-531.

*Primary Examiner*—Eugene R. LaRoche
*Assistant Examiner*—Son Dinh
*Attorney, Agent, or Firm*—Irving S. Rappaport; William H. Murray; Frank M. Linguiti

[57] ABSTRACT

An integrated circuit electronic grid device includes first and second metal layers wherein a layer of a dielectric medium is disposed between the metal layers. A third metal layer is disposed above the second metal layer and insulated from the second metal layer by another layer of a dielectric medium. The first and second metal layers are biased with respect to each other to cause a flow electrons from the first metal layer toward the second metal layer. The second metal layer is provided with a large plurality of holes adapted for permitting the flow of electrons to substantially pass therethrough and to travel toward the third metal layer. A fourth metal layer is disposed above the third metal layer to collect the electrons wherein the third metal layer is also provided with a large plurality of holes to permit the electrons to flow therethrough and continue toward the fourth metal layer. The third metal layer is coupled to a lead to permit it to serve as a control grid for modulating the flow of electrons.

44 Claims, 2 Drawing Sheets

INTEGRATED CIRCUIT ELECTRONIC GRID DEVICE AND METHOD

BACKGROUND OF THE INVENTION

1. Field of the Invention

This invention relates to the field of electronic grid devices and in particular to electronic grid devices pertaining to integrated circuits.

2. Background Art

Hot-electron thin film devices are known in the art. For example, the "Handbook of Thin Film Technology", edited by Leon I. Maissel and Reinhard Glang, McGraw-Hill, Inc., 1970, discloses a tunnel-cathode emitter. The tunnel cathode is based on the fact that the electron energy is conserved during the tunnel process. Thus in tunneling from one electrode to the other, such that $eV<d_o$, the electrons enter the positively biased electrode with an energy level eV above the Fermi level of the electrode. The electrons then give up their energy to the lattice and fall into the Fermi sea.

For voltage biases such that $eV>d_o$, the electrons first tunnel into the conduction band of the insulator before entering the positively biased electrode. The electron is then assumed to be accelerated by the field within the insulator, without undergoing energy losses, to again enter the positively biased electrode with energy eV above the Fermi level. If eV is less than the positively biased electrode work function C, the electron gives up its energy to the electrode lattice as previously described. However, if $eV>C$ and less than the mean free path of the electrons, the electrons may pass through the electrode to the vacuum interface with little loss of energy, and thus escape into the vacuum.

It is thus believed that with a suitable geometry and voltage bias, a large fraction of the tunneling electrons should be able to escape from the tunnel junction into the vacuum and be collected by a suitably biased anode. The tunnel junction then, in principle, is a cold cathode. However, such cathodes are extremely inefficient, having transfer ratios typically on the order of $10^{-4}$ or $10^{-3}$ wherein the transfer ratio is understood to be the ratio of emission current to circulating current. These low values of the ratio of emission apparently result from the fact that the majority of electrons undergo energy losses while traveling in the conduction band of the insulator and the metal film. The attenuation of electrons appears to be directly related to the square of the thickness of the metal film.

It is also known to provide a tunnel-emission triode wherein a second insulator, assumed to be less than the electronic mean free path, and a third electrode are deposited onto the cold cathode. In the tunnel emission triode, the energy of electrons tunneling between the emitter and base electrode is assumed to be conserved when they reach the interface existing between the base and the second insulator. At this point electrons may not have sufficient energy to enter the conduction band of the second insulator. If the energy level is high enough electrons can enter the conduction band of the second insulator, in which case they are then accelerated toward and collected by the collector which is positively biased with respect to the base during operation. Thus the second insulator and collector serve the same function as the vacuum interspace and anode in the cold-cathode emitter.

However, the tunnel emission triode suffers from all the disadvantages of the cold cathode, plus additional problems arising from scattering and trapping in the collector insulator, which are not present in the vacuum interspace between the tunnel junction and anode comprising the cold cathode.

It is well known in the art that at high temperatures the properties of the semiconductor materials which form the semiconductor integrated circuits change, causing devices to operate improperly. It is known in the art to cool such devices in order to maintain their performance under conditions in which their temperature would be raised above the operating limit. This permits these devices to be operated with more watts per square centimeter than a similar circuit without cooling. However, the cooling of these integrated circuit devices can be a serious drain on resources and a serious limitation on what can be accomplished using these chips.

It is also known in the art that semiconductor device are sensitive to transient radiation because of bulk generation of charge carriers in the active regions of these devices. For example, alpha particles can cause a charge which can latch up a device. These charge carriers tend to negate the topology of transitions and render them inoperable for the duration of the transient.

It is also known in the art to use a silicon micromachining procedure to fabricate micro-cavity integrated vacuum tubes. This procedure can be performed with known integrated circuit processing equipment. The cathode, grid and anode of the vacuum tube is fabricated using planner technology so that the innerconnection of many devices can be easily achieved. Low temperature chemical deposited oxide is used to separate the grid from the cathode and to separate the anode from the grid. Low temperature chemical vapor deposited oxide is also used as a sacrificial layer to etch cavities in the area of the field emitting points. Grid openings of a micron and registration accuracy between layers of 0.1 micrometers have been achieved. These devices use field emission rather than thermionic emission to generate charged carriers. All this is useful because miniature vacuum tubes are more radiation and temperature tolerant. This is useful in fission reactors, fusion reactors, and accelerators having instrumentation, control, and power conditioning electronics which are subjected to high temperatures and radiation fields.

These devices consist of a silicon field-emission pyramid on a silicon substrate. The pyramid is created by anisotropic etching of silicon. The field emitter is buried in the layer of phosphorous-doped silicon dioxide glass which is reflowed to make it more planer. Above the glass a pattern strip of doped polysilicon is deposited. The strip has a hole in it centered over the field emitter. In this device ion-bombardment damage or sputtering of the field emission tip is a serious problem. Additionally, the usefulness of these devices is limited because of the low level of electron flow which is possible from the field emission tip. Furthermore, voltages on the order of 50 volts to 150 volts are required to operate these devices.

SUMMARY OF THE INVENTION

An integrated circuit electronic grid device includes first and second metal layers wherein a layer of a dielectric medium is disposed between the two metal layers, providing insulation between the metal layers. A third metal layer is dispose above the second metal layer and is insulated from the second metal layer by another layer of a dielectric medium. The first and second metal layers are biased with respect to each other to cause an electron flow from the first metal layer toward the second metal layer. The second metal layer is provided with a plurality of holes for permitting the flow of electrons to substantially pass therethrough and to travel toward the third metal layer. A fourth metal layer is disposed above the third metal layer to collect the electrons wherein the third metal layer is also provided with a large plurality of holes to permit the electrons to flow therethrough and continue toward the fourth metal layer. The third metal layer is coupled to a lead to permit the third metal layer to serve as a control grid.

DETAILED DESCRIPTION OF THE INVENTION

Figure 1A:
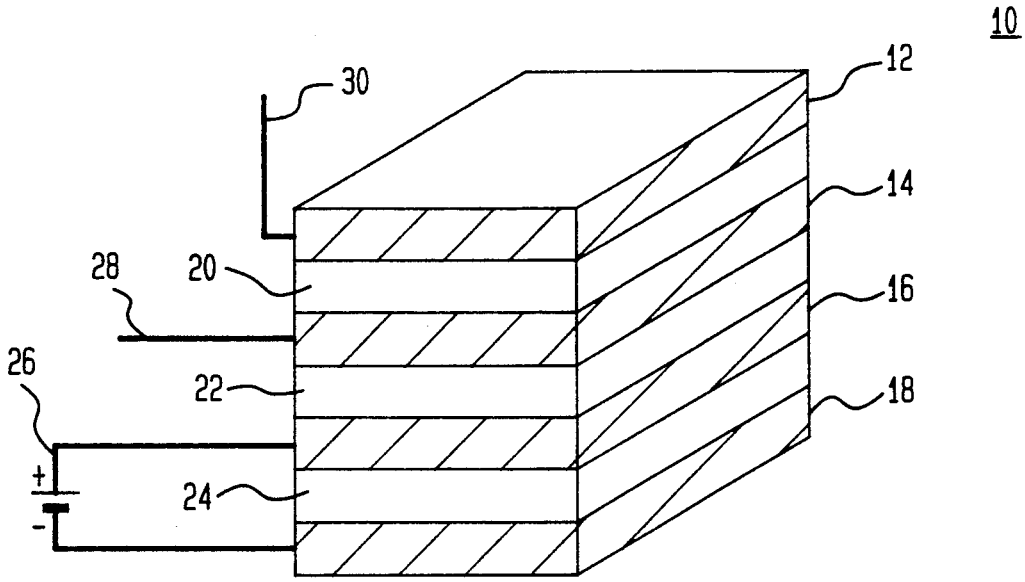
FIGS. 1*a* and 1*b* show the integrated circuit electronic grid device of the present invention.

Referring now to FIGS. 1*a, b* there is shown integrated circuit electronic grid device 10 of the present invention. Integrated circuit electronic grid device 10 is formed of four metal layers 12, 14, 16 18 separated by three layers 20, 22, 24 of a dielectric medium such as a vacuum, air, or silicon dioxide. In an alternate embodiment, integrated circuit electronic grid device 10 may be provided with a plurality of further metal layers (not shown) separated by further dielectric layers (not shown) wherein the further layers may alternate as set forth for metal layers 12, 14, 16, 18 and layers 20, 22, 24 of dielectric medium. Structurally, integrated circuit electronic grid device 10 is substantially similar to a capacitor, formed of metal layers 12, 18, with two thin conducting plates 14, 16 between metal layers 12, 18.

Figure 2:
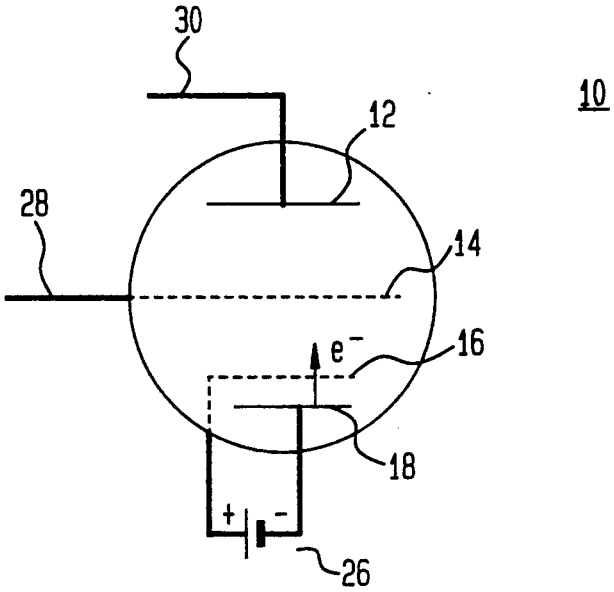
FIG. 2 shows a schematic representation of the integrated circuit electronic grid device of FIGS. 1*a, b.*
Figure 1B:
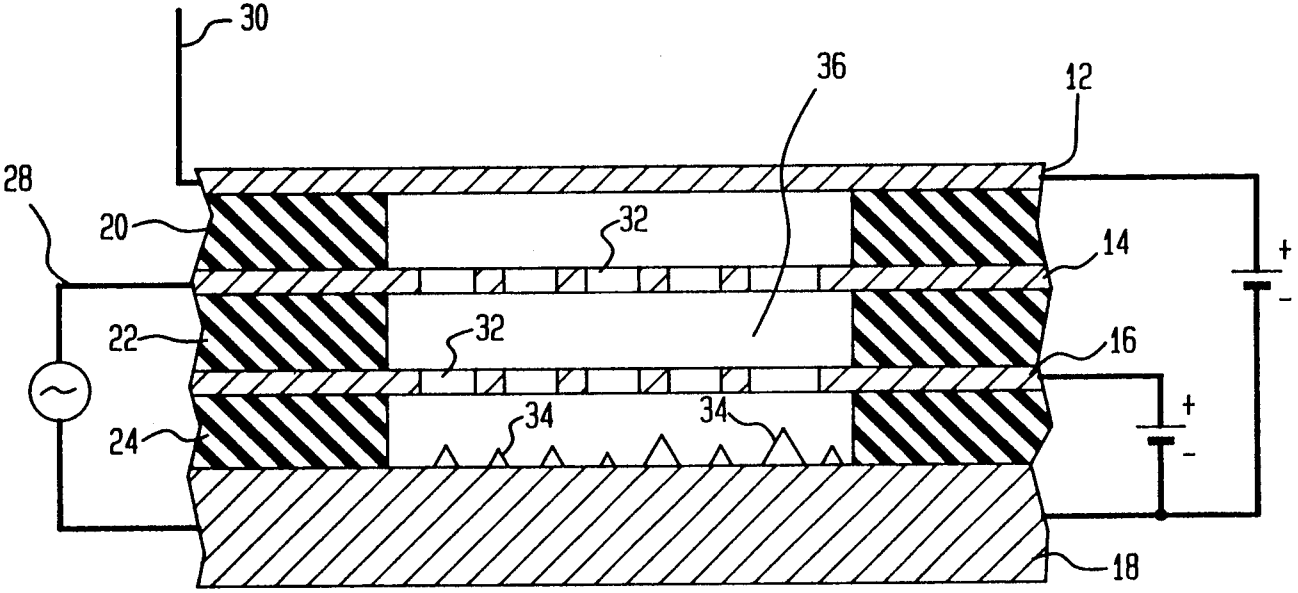

Referring now to FIG. 2, there is shown a schematic representation of integrated circuit electronic grid device 10. Metal layer 16 of integrated circuit electronic grid device 10 is biased positive with respect to metal layer 18 by direct current voltage source 26. The positive biasing of metal layer 16 with respect to metal layer 18 starts a field emission upward from metal layer 18 or electrode 18 toward metal layer 16 or emission grid 16. This causes electrons from the surface of metal layer 18 to pass through dielectric layer 24 by a tunneling process. A voltage potential of approximately five to ten volts between metal layer 16 and metal layer 18 produces a strong enough field to provide the electron tunneling required for electrons to pass through dielectric layer 24 if the distance between metal layer 16 and metal layer 18 is small enough. However, potentials of hundreds of volts may be used. In any event the operating voltage is well below the operating voltage of single emitter semiconductor diode devices.

Emission grid 16 is adapted to permit the electron flow through dielectric layer 24 to pass through emission grid 16 by providing emission grid 16 with a large number of holes 32. The electrons which pas through holes 32 of emission grid 16 then continue upward through dielectric layer 22 by the sam tunneling process which occurs through dielectric layer 24. Thus integrated circuit grid device 10 may serve as a basic rectification device.

Control grid 14 is provided with a large number of holes 32 in a manner similar to that described for emission grid 16 in order to permit a flow of electrons through control grid 14. The electrons therefore pass through holes 32 of control grid 14 and then pass through dielectric layer 20, again by tunneling. After passing through dielectric layer 20 the electrons reach metal plate 12 if metal plate 12 is also provided with a positive bias.

Metal layer 14 or control grid 14 can thus modulate or control the electron flow from electrode 18 through grid device 10 to plate 12. An external control signal or modulation signal for controlling or modulating grid device 10 can be applied to control grid 14 by way of external control coupling line 28. After passing through dielectric layer 20 to electrode 12 or plate 12, the electrons are collected at plate 12 by way of line 30. Thus integrated circuit electronic grid device 10 may function in a manner similar to a vacuum tube with a cold cathode emitter and a signal can be amplified by integrated circuit electronic grid device 10 by applying the signal to control grid 14. Device 10 may be formed into a triode, a quatrode and so on by providing further control grids (not shown). Additionally, integrated circuit electronic grid device 10 can function as an amplifier or as a switch.

It is essential that emission grid 16 and control grid 14 both be formed with a very large fractional area of holes 32 through them in order for the liberated electrons to have higher transmission through emission grid 16 and control grid 14. More particularly, the ratio of the number of holes 32 to the surface metal area of emission grid 16 and control grid 14 must be maximized while assuring that the metal areas are continuously electrically coupled at all points within grids 16, 14. The area of holes 32 may be in excess of fifty percent of the area of emission grid 16 and control grid 14 to permit electrons to pass therethrough. Preferably seventy percent to eighty percent of the surface area of grids 16, 14 should be the area of holes 32. Furthermore, emission grid 16 and control grid 14 should be as thin as possible, one thousand angstroms or less, to minimize electron capture by the metal of the grid layers. However, it is believed that the thicknesses of grids 14, 16 may be several thou sand angstroms. All metal layers 12, 14, 16, 18 of integrated circuit electronic grid device 10 may be formed of a substantially high temperature resistant metal such as tungsten, alloys of tungsten, or other refractory metals or alloys. The holes of grids 14, 16 do not necessarily have to be aligned with respect to emitters 34.

The forming of a large number of holes 32 through emission grid 16 and control grid 14 can be accomplished in a number of ways. A two-phase metal film can be formed by deposition and phase segregation at elevated temperatures on dielectric layers 22, 24 to control grid 14 and control grid 16. A metal matrix is thereby formed on the dielectric due to the presence of the two metals within the two-phase film. A secondary phase of the two-phase metal is then etched from the metal matrix of the film. This causes the metal film to be provided with a large number of holes 32 while keeping the metal electrically continuous over its entire surface because a conducting metal matrix remains when the second phase is etched away. While it is believed that a two-phase film is preferred, it will be understood by those skilled in the art that a one-phase film or other multi-phase films may be used.

Another way that emission grid 16 and control grid 14 may be formed with a large number of holes 32 is by randomly removing metal of a thin metal film deposition using a fine spray which locally attacks and removes small areas of metal from the metal film deposition. Additionally, holes 32 for grids 14, 16 can be formed in a process wherein the metal film depositions for control grid 14 and emission grid 16 are heated to a temperature high enough to make them agglomerate. Regions of the thin film can then be etched away. Furthermore, other techniques, such as standard lithographic techniques, can also be used.

For one square micron plates 12, 18, it would be desirable to form hundreds to thousands of holes 32 in emission grid 16 and control grid 14 between metal plates 12, 18. This would require that the average size of holes 32 in emission grid 16 and control grid 14 be reduced to below one hundred angstroms in diameter. Further, with respect to dielectric layers 20, 22, 24, these layers can be formed of polycrystalline material rather than monocrystalline material thus removing a number of design restrictions and avoiding crystalline perfection requirements.

In addition to providing emission grid 16 and control grid 14 having a maximum number of holes in relation to the surface area of the thin film forming grids 14, 16, another crucial factor for providing an electron flow from electrode 18 which can be modulated using control grid 14 and collected from plate 12 is a good field emission interface at the surface of electrode 18. A good field emission interface is necessary so that when emission grid 16 is biased positive with respect to-electrode 18, a good source of electrons is emitted from the surface of electrode 18 into dielectric layer 24. The emitting interface of electrode 18 in contact with the surface of dielectric layer 24 can be made to release electrons more easily by roughening it atomically thereby creating a large number of microscopic emitters 34 for emitting electrons from the surface of metal layer 18 into layer 24 of dielectric medium. Providing a large number of emitters 34 for emitting electrons greatly increases the amount of current through dielectric layer 24. A further increase in electron emission can be achieved by heating electronic grid device 10. The emitting interface of electrode 18 can also be roughened to provide emitters 34, for example, by heating electrode 18 in ambient oxygen and then reducing the surface of electrode 18 by heating electrode 18 in hydrogen gas.

With respect to dielectric layers 20, 22, 24, these layers should be very thin to minimize scattering of electrons with ions as the electrons ballistically propagate through dielectric layers 20, 22, 24. The distances between metal layers 12, 14, 16, 18 should therefore be reduced preferably to between three hundred and four hundred angstroms. Dielectric layers 20, 22, 24 may be formed of any suitable dielectric medium. Dielectric layers 20, 22, 24 may be air region 31 or vacuum region 31, - or a partial vacuum region 31 when metals layers 12, 14, 16, 18 are separated, for example, by small regions of a supporting material such as a semiconductor dielectric like silicon nitride. Additionally, dielectric layers 20, 22, 24 may be a conventional semiconductor dielectric such as silicon dioxide. Semiconductor dielectric layers 20, 22, 24 may be simultaneously etched to provide air dielectric layers 20, 22, 24. One or more dielectric layers 20, 22, 24 may be formed of a substantially high temperature resistant material such as silicon dioxide. Maximum radiation hardening occurs when dielectric layers 20, 22, 24 are vacuum layers.

If electrons emitted from emitters 3 of the surface of electrode 18 when emission grid 16 is positively biased with respect to electrode 18 acquire a velocity of one one-hundreth of the speed of light, wherein the mean free path of electrons may be on the order of greater than a few microns, then transit times on the order of one picosecond or less may be achieved. Thus integrated circuit electronic grid device 10 can achieve large electron velocities and short transit times. Integrated circuit electronic grid device 10 can thus be used to make a very high speed device.

Integrated circuit electronic grid device 10 of the present invention may be formed of substantially high temperature resistant materials in order to provide high efficiency operation. For example, as previously described, all metal layers 12, 14, 16, 18 of integrated circuit electronic grid device 10 may be formed of a substantially high temperature resistant metal such as tungsten or other refractory metals. One or more dielectric layers 20, 22, 24 may be formed of substantially high temperature resistant material such as silicon dioxide or other refractory dielectrics. Thermal energy may then be applied to integrated circuit electronic grid device 10 causing an increased supply of electrons to be emitted from thermionic emission grid 16. This increased supply of electrons causes an increase in the efficiency of operation of integrated circuit electronic grid device 10. Because the performance of integrated circuit electronic grid device 10 improves at higher temperature, integrated circuit electronic grid device 10 has extremely good thermal characteristics and does not have to be cooled when used in operations which cause a very high density of watts per square centimeter. It is believed that the temperature range of such a high temperature resistant electronic grid device 10 is approximately five hundred degrees Centigrade to one thousand degrees Centigrade.

It will be understood that various changes in the details, materials and arrangements of the parts which have been described and illustrated in order to explain the nature of this invention, may be made by those skilled in the art without departing from the principle and scope of the invention as expressed in the following claims.

It is claimed:

1. An integrated circuit electronic grid device, comprising:

a first conductive layer having a conductive surface with a plurality of emitters disposed upon said conductive surface, a second conductive layer disposed above said first conductive layer and insulated from said first conductive layer by a first dielectrical medium, electrical biasing means coupled to said first and second conductive layers for providing an electrical bias between said first and second conductive layers to provide a flow of electrons from said emitters of said first conductive layer toward said second conductive layer, and said second conductive layer being formed with a plurality of holes therethrough adapted for permitting said flow of electrons to pass through said second conductive layer, the holes of said plurality of holes and the emitters of said plurality of emitters being disposed in a substantially nonaligned arrangement with respect to each other.

2. The integrated circuit electronic grid device of claim 1, further comprising a third conductive layer disposed above said second conductive layer and insulated from said second conductive layer by a second dielectric medium.

3. The integrated circuit electronic grid device for claim 2, further comprising a fourth conductive layer disposed above said third conductive layer and insulated from said third conductive layer by a third dielectric medium.

4. The integrated circuit electronic grid device of claim 3, further comprising means for applying a modulation signal to said third conductive layer to modulate said flow of electrons in accordance with said modulation signal.

5. The integrated circuit electronic grid device of claim 2, wherein said third conductive layer is formed with a plurality of holes therethrough, said holes adapted to permit electrons to pass therethrough.

6. The integrated circuit electronic grid device of claim 4, wherein said fourth conductive layer is adapted to collect electronic of said modulated flow of electrons.

7. The integrated circuit electronic grid device of claim 1, wherein said second conductive layer comprises a metal matrix formed of an etched multi-phase metal film.

8. The integrated circuit electronic grid device of claim 1, wherein said second conductive layer is an etched agglomerate.

9. The integrated circuit electronic grid device of claim 5, wherein at least a portion of said holes are non-aligned with respect to said emitters.

10. The integrated circuit electronic grid device of claim 8, wherein said surface of said first conductive layer comprises an atomically roughened surface.

11. The integrated circuit electronic grid device of claim 1, wherein said dielectric medium is air.

12. The integrated circuit electronic grid device of claim 1, wherein said dielectric medium is a partial vacuum.

13. The integrated circuit electronic grid device of claim 3, comprising a plurality of further conductive layers disposed above fourth conductive layer, each of said further conductive layers insulated from other layers by further layers of a dielectric medium.

14. The integrated circuit electronic grid device of claim 1, wherein at least one of said first and second conductive layers and said first dielectric medium are formed of substantially high temperature resistant material.

15. The integrated circuit electronic grid device of claim 14, wherein at least one of said first and second conductive layers is formed of tungsten.

16. The integrated circuit electronic grid device of claim 14, wherein said first dielectric medium is formed of silicon dioxide.

17. The integrated circuit electronic grid device of claim 14, wherein said electronic grid device is adapted to operate at temperature above five hundred degrees Centrigrade.

18. A method for forming an integrated circuit electronic grid device upon a semiconductor wafer, comprising the steps of:

disposing a first conductive layer upon the surface of said semiconductor wafer, disposing a plurality of emitters upon the surface of said first conductive layer, disposing a second conductive layer above said first conductive layer and insulating said second conductive layer from said first conductive layer by a first dielectric medium, electrically biasing said first conductive layer with respect to said second conductive layer to provide a flow of electrons from said emitters of said first conductive layer toward said second conductive layer, and forming said second conductive layer with a plurality of holes therethrough adapted for permitting said flow of electrons to pass through said second conductive layer, the holes of said plurality of holes and the emitters of said plurality of emitters being disposed in a substantially non-aligned arrangement with respect to each other.

19. The method for forming an integrated circuit electronic grid device of claim 18, comprising the further step of disposing a third conductive layer above said second conductive layer and insulating said third conductive layer from said second conductive layer by a second dielectric medium.

20. The method for forming an integrated circuit electronic grid device of claim 19, comprising the further step of disposing a fourth conductive layer above said third conductive layer and insulating said fourth conductive layer from said third conductive layer by a third dielectric medium.

21. The method for forming an integrated circuit electronic grid device of claim 19, comprising the further step of applying a modulation signal to said third conductive layer to modulate said flow of electrons in accordance with said modulation signal.

22. The method for forming an integrated circuit electronic grid device of claim 19, wherein the step of disposing said third conductive layer above said second conductive layer is followed by the step of forming a plurality of holes through said third conductive layer, said holes adapted to permit electrons to pass therethrough.

23. The method for forming an integrated circuit electronic grid device of claim 21, wherein said fourth conductive layer is adapted to collect electrons of said modulated flow of electrons.

24. The method for forming an integrated circuit electronic grid device of claim 18, wherein the step of forming said plurality of holes through said second conductive layer comprises etching a multi-phase metal film to form a metal matrix having holes.

25. The method for forming an integrated circuit electronic grid device of claim 18, wherein the step of forming said plurality of holes through said second conductive layer comprises etching an agglomerate.

26. The method for forming an integrated circuit electronic grid device of claim 22, comprising the further step of disposing at least a portion of said plurality of holes non-aligned with respect to said emitter.

27. The method for forming an integrated circuit electronic grid device for claim 18, wherein said dielectric medium is air.

28. The method for forming an integrated electronic grid device of claim 18, wherein said dielectric medium is a partial vacuum.

29. The method for forming an integrated circuit electronic grid device of claim 18, wherein disposing said layers comprises disposing substantially high temperature resistant layers.

30. The method for forming an integrated circuit electronic grid device of claim 29, wherein the steps of disposing said first and second conductive layers comprise disposing at least one layer formed of tungsten.

31. The method for forming an integrated circuit electronic grid device of claim 29, wherein the step of insulating said second conductive layer from said first conductive layer comprises providing a layer formed.

32. The method for forming an integrated circuit electronic grid device of claim 27, comprising the further step of operating said grid device at a temperature above five hundred degrees Centigrade.

33. The method for forming an integrated circuit electronic grid device of claim 20, comprising the further step of disposing a plurality of further conductive layers above said fourth conductive layer and insulating each further conductive layer by a further layer of said dielectric medium.

34. A method for forming a high efficiency integrated circuit electronic grid device upon a semiconductor wafer, comprising the steps of:

(a) disposing a first substantially high temperature resistant conductive layer upon the surface of said semiconductive wafer, the surface of said first conductive layer having a plurality of emitters disposed thereupon, (b) disposing a second conductive layer above said first substantially high temperature resistant conductive layer and insulating said second conductive layer from said first substantially high temperature resistant conductive layer by a first substantially high temperature resistant dielectric medium, (c) electrically biasing said first substantially high temperature resistant conductive layer with respect to said second conductive layer to provide a flow of electrons from said emitters of said first substantially high temperature resistant conductive layer towards said second conductive layer, (d) applying thermal energy to said first substantially high temperature resistant conductive layer to provide an increased flow of electrons from the surface of said first substantially high temperature resistant conductive layer, and (e) forming said second conductive layer with a plurality of holes therethrough for permitting said flow of electrons to pass through said second conductive layer wherein the emitters of said plurality of emitters and the holes of said plurality of holes are disposed in a substantially nonaligned arrangement with respect to each other.

35. The method for forming a high efficiency integrated circuit electronic grid device of claim 34, wherein step (b) comprises disposing a second substantially high temperature resistant conductive layer above said first substantially high temperature resistant conductive layer.

36. The method for forming a high efficiency integrated circuit electronic grid device of claim 34, wherein step (b) comprises disposing a second low temperature resistant conductive layer above said first substantially high temperature resistant conductive layer.

37. The method for forming a high efficiency integrated circuit electronic grid device of claim 34, comprising the further step of disposing a third conductive layer above said second conductive layer and insulating said third conductive layer form said second conductive layer by a second dielectric medium.

38. The method for forming a high efficiency integrated circuit electronic grid device of claim 37, comprising the further step of disposing a fourth conductive layer above said third conductive layer and insulating said fourth conductive layer from said third conductive layer by a third dielectric medium.

39. The method for forming a high efficiency integrated circuit electronic grid device of claim 38, comprising the further step of disposing a plurality of further conductive layers above said fourth conductive layer and insulating each further conductive layer with a further layer of dielectric medium.

40. The method for forming a high efficiency integrated circuit electronic grid device of claim 37, comprising the further step of forming said third conductive layer with a plurality of holes therethrough for permitting said flow of electrons to pass through said third metal layer.

41. The integrated circuit electronic grid device of claim 1, wherein at least one of said first and second conductive layers is formed of metal.

42. The integrated circuit electronic grid device of claim 18, wherein at least one of said first and second conductive layers is formed of metal.

43. The method for forming a high efficiency integrated circuit electronic grid device of claim 34, wherein at least one of steps (a) and (b) comprises disposing a metal layer.

44. An integrated circuit electronic grid device, comprising:

a first conductive layer, a second conductive layer disposed above said first conductive layer and insulated from said first conductive layer by a first dielectric medium, said second conductive layer being formed with a plurality of holes therethrough adapted for permitting a flow of electrons to pass through said second conductive layer, the surface of said first conductive layer having at least first and second emitters disposed thereupon for providing respective first and second emitter electron flows, and said first and second emitters being disposed in a substantially nonaligned arrangement with respect to a single hole of said plurality of holes for passing said first and second electron flows through said single hole.

* * * * *